US005306102A

United States Patent [19]

Ota

[11] Patent Number: 5,306,102

[45] Date of Patent: Apr. 26, 1994

[54] PRINT SIMULATION FOR MODE SELECTION

[75] Inventor: Yuichi Ota, Anjo, Japan

[73] Assignee: Brother Kogyo Kabushiki Kaisha, Nagoya, Japan

[21] Appl. No.: 990,246

[22] Filed: Dec. 14, 1992

[30] Foreign Application Priority Data

Dec. 26, 1991 [JP] Japan ..... 3-358986

[51] Int. Cl.[5] ..... B41J 5/00

[52] U.S. Cl. ..... 400/76; 400/61; 395/115

[58] Field of Search ..... 400/61, 76; 395/114, 395/115, 116

[56] References Cited

U.S. PATENT DOCUMENTS 4,968,159 11/1990 Sasaki et al. ..... 400/76

*Primary Examiner*—David A. Wiecking
*Assistant Examiner*—Steven S. Kelley
*Attorney, Agent, or Firm*—Oliff & Berridge

[57] ABSTRACT

In the printing apparatus which can carry a plurality kinds of operation modes, it can be determined whether an operation mode of the printing information sent from an external source is HP mode having control code or PS mode without control code. In such a printing apparatus, a simulation printing operation is carried out without printing using an operation mode P, which is a simulation mode of PS mode. As a result of the simulated printing, it is determined whether the printing information has a format that satisfies the format X of PS mode. If it is determined that the printing information has a format that satisfies the format X of PS mode, the printing information is processed as that of PS mode and the printing data is sent to the laser printer engine. On the other hand, if it is determined that the printing information does not have a format that satisfies the format X of PS mode, the printing information is processed as that of HP mode and the printing data is sent to the laser printer engine.

16 Claims, 5 Drawing Sheets

Fig.2B

| ITEM | INSTRUCTIONS |
|---|---|
| S1 | SELF-TEST RAM IS INITIALIZED |
| S2 | PRINTING INFORMATION INPUT FROM HOST COMPUTER ? |
| S3 | STORE INPUT PRINTING INFORMATION IN THE RECEIVING BUFFER |
| S4 | THE SIMULATION PRINT FLAG IS SET TO 1 |
| S5 | PERFORM SIMULATION PRINTING IN A SIMULATION MODE OF PS MODE |
| S6 | THE PRINTING INFORMATION SATISFIES THE FORMAT X ? |
| S7 | THE SIMULATION PRINT FLAG IS SET TO 0 |
| S8 | PRINT IN HP MODE |
| S9 | THE SIMULATION PRINT FLAG IS SET TO 0 |
| S10 | PRINT IN PS MODE |

Fig.3B

| ITEM | INSTRUCTIONS |
|---|---|
| S1 | SELF-TEST RAM IS INITIALIZED |
| S2 | PRINTING INFORMATION INPUT FROM HOST COMPUTER ? |
| S3 | STORE INPUT PRINTING INFORMATION IN THE RECEIVING BUFFER |
| S4 | THE SIMULATION PRINT FLAG IS SET TO 1 |
| S5 | PERFORM SIMULATION PRINTING IN A SIMULATION MODE OF PS MODE |
| S6 | THE PRINTING INFORMATION SATISFIES THE FORMAT X ? |
| S9 | THE SIMULATION PRINT FLAG IS SET TO 0 |
| S10 | PRINT IN PS MODE |
| S11 | PERFORM SIMULATION PRINTING IN A SIMULATION MODE OF PW MODE |
| S12 | THE PRINTING INFORMATION SATISFIES THE FORMAT Y ? |
| S13 | THE SIMULATION PRINT FLAG IS SET TO 0 |
| S14 | PRINT IN HP MODE |
| S15 | THE SIMULATION PRINT FLAG IS SET TO 0 |
| S16 | PRINT IN PW MODE |

PRINT SIMULATION FOR MODE SELECTION

BACKGROUND OF THE INVENTION

1. Field of the Invention

The invention relates to a control device for a printing apparatus having a plurality of operation modes.

2. Description of Related Art

Various kinds of printing apparatuses are in use in which, when printing is carried out based on printing information input from an external device, letters, figures and the like commanded to be printed are printed in accordance with control codes, such as bold face, subscript, line feed, form feed and the like, contained in the printing information.

In addition, in order to enable more varied printing, the printing apparatuses have their own peculiar operation modes such as a high-speed mode for carrying out printing at high speed, designation of dot space and bit image and the like. These modes are also designated by the control codes, in particular, escape control codes (ESC sequence code) in the printing information.

In this case, the control codes including the escape control codes are usually peculiar to the printing apparatus or the manufacturer of the printing apparatus. For example, in DIABLO MODE, "ESC6" is a control code for BACKWARD-PRINT-MODE-ON, while the same is a control command code for PRINTABLE-CODE-AREA-EXPANSION in EPSON MODE, or for SELECT-INTERNATIONAL-CHARACTER-SET in IBM MODE. Thus, the same ESC sequence code has a different instruction in a different operation mode.

Therefore, a printing apparatus on the market cannot carry out the desired printing so long as the printing information is not compatible with the operation mode of the printing apparatus used. Thus, a printing apparatus has been developed in which an operation mode is selected from a plurality of operation modes, in compli7 ance with the printing information, by an operator and the input printing information is printed in accordance with the selected operation mode.

However, in the above-described printing apparatus, it is required for an operator to know, before inputting printing information, the operation mode in which the printing information is to be printed and determine which one of the plurality of possible operation modes is compatible with the printing information desired to be printed for selection of the appropriate one of the operation modes. Therefore, the operation to select an operation mode becomes more complex and it is especially difficult for beginners to execute the complete printing operation.

In view of the above, a printing apparatus, disclosed in U.S. Pat. No. 4,968,159, has been developed. A plurality of operation modes are found in the printing apparatus and an operation mode which is compatible with the input printing information is automatically selected.

In order to provide in the printing apparatus the automatic selection of an operation mode, in compli7 ance with the printing information, control codes, which are included within a predetermined amount of first input printing information, are analyzed to determine the operation mode in which the control codes exist. According to the determination, an operation mode in which the printing information is to be printed is automatically selected from the plurality of operation modes available. In the printing apparatus, since no complicated operation is required of an operator, operational mistakes do not occur and it is easy for beginners to use the printing apparatus.

However, in the above-described printing apparatus, any operation mode which substantially does not have any control codes cannot be distinguished from among the plurality of possible operation modes, because the operation mode which is compatible with the printing information is determined by control codes such as above-described ESC sequence codes included in the printing information to be printed. That is, if the operation mode of the printing information to be printed does not substantially have any control codes such as ESC sequence codes, the operation mode cannot be determined by control codes since the printing information does not have any control codes by which the operation mode is determined.

For example, a printing apparatus having two operation modes, such as the HP mode (Hewlett Packard mode) having ESC sequence code and the PS mode (Post Script mode) without ESC sequence code. If printing information of the PS mode, without ESC sequence code, is input to the printing apparatus, PS mode in which the printing information is to be printed cannot be distinguished from HP mode by analyzing ESC sequence codes since the printing information does not have any ESC sequence code.

SUMMARY OF THE INVENTION

An object of the invention is to provide a control device for a printing apparatus which can automatically distinguish an operation mode without the presence of a control code from an operation mode having a control code.

According to the invention, a control device for a printing apparatus comprises:

printing data storing means for storing printing data;

printing means for printing images of the printing data on a printing medium;

driving means for driving the printing means;

operation mode storing means for storing at least one operation mode having a control code and at least one operation mode without a control code in one of which printing is carried out according to the printing data;

simulation printing means for simulating printing the printing data in a simulating operation mode corresponding to an operation mode stored in the operation mode storing means without executing the driving means;

error judging means for judging if an error has occurred when the simulating operation mode is executed by the simulation printing means; and printing control means for controlling the driving means to drive the printing means to carry out printing according to the printing data in an operation mode corresponding to the simulating operation mode when the judging means judges an error has not occurred.

During operation of the control device of a printing apparatus having the above-mentioned structure, printing of the printing data stored in the printing data storing means is simulated in a simulating operation mode corresponding to an operation mode, without control codes, stored in the operation mode storing means without executing the driving means. During the simulation printing, if a judging means does not detect an error, the driving means is controlled by the printing control means to print the printing data in the operation mode corresponding to the simulating operation mode.

As is clear from the above-described explanation, in the control device for a printing apparatus, a printing operation is simulated in a simulating operation mode corresponding to an operation mode without control codes, without printing according to the printing information input from an external source. Then, it can be determined whether the input printing information is to be printed in an operation mode, without control codes or not, by judging whether a format error occurred during the simulation printing.

BRIEF DESCRIPTION OF THE DRAWINGS

A preferred embodiment of the invention will be described in detail with reference to the following figures, wherein:

FIG. 2B is a table of labels for the flowchart of FIG. 2A;

FIG. 3B is a table of labels for the flowchart of FIG. 3A.

DETAILED DESCRIPTION OF THE PREFERRED EMBODIMENT

A first embodiment of the invention will be explained with reference to the drawings.

Figure 1:
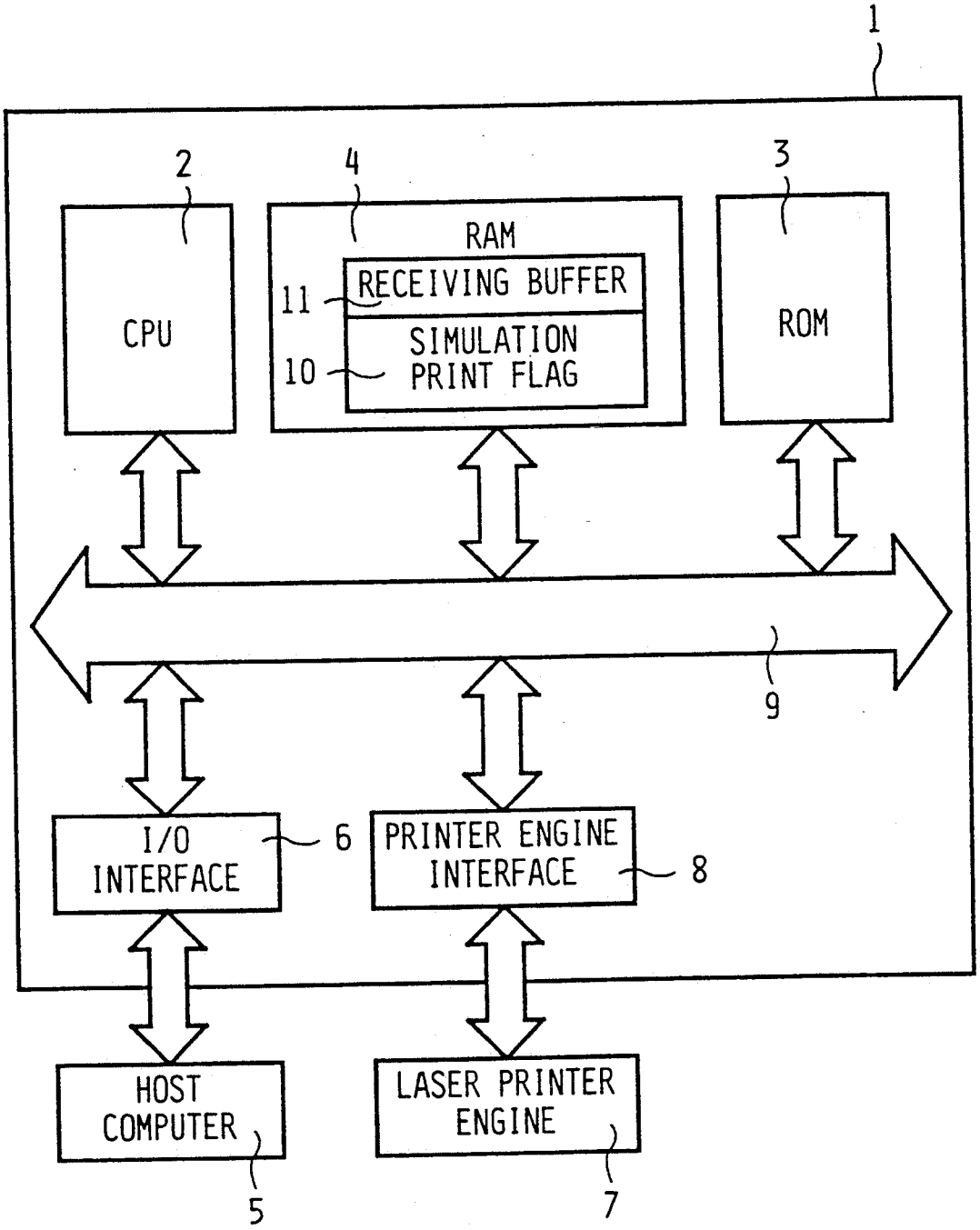
FIG. 1 is a block diagram of one preferred embodi7 ment of the invention.

First, the electric structure of a control device 1 of a laser printer, which is the printing apparatus with which the invention is used for purposes of explanation, is explained with reference to FIG. 1. The invention can be used with other types of printers, such as ink jet or dot matrix printers, as well.

The control device 1 has a CPU 2 for controlling the laser printer, a ROM 3, a RAM 4, an I/O interface 6 for connecting the control device 1 with a host computer 5, a printer engine interface 8 for connecting the control device 1 with a laser printer engine 7 and a bus 9 for connecting the above-mentioned parts with each other.

Various control programs and operation modes of the laser printer are stored in ROM 3. In this first embodi7 ment, two operation modes comprising a HP mode (Hewlett Packard mode) having a control code of ESC sequence code and a PS mode (Post Script mode) without the control code of ESC sequence code are stored in ROM 3.

An example of the printing information of the HP mode sent to the laser printer, containing the control code of ESC sequence code, is as follows:

An example ("We are brothers.") of the printing information of the HP mode sent to the laser printer containing the control code of ESC sequence code is as follows:

<ESC> E We are brothers. <FF>

In the printing information, an ESC sequence code of <ESC> E is a printer reset command for resetting the printer in to HP mode. The character data of "We are brothers." comes after the ESC sequence code. <FF> is a printing execution command for instructing the printer to execute a printing operation in HP mode. In HP mode, when the above-described printing information is sent to the laser printer in a printing operation, "We are brothers." is printed on a printing paper.

In HP mode, default data, such as font style, size, and printing position of characters, are set at the initial setting. Therefore, only when an operator sets control codes for a font style, a size, a printing position and so on using ESC sequence codes for font style, a size, a printing position of characters and so on respectively, are then sent to the printer with the character code.

On the other hand, in PS mode, that does not use a control code of ESC sequence code, an example of printing information sent to the laser printer, upon depression of a printing key by the operator, is as follows:

/Times-Roman findfont 10 scalefont setfont 50 2000 moveto (We are brothers.)show showpage "Times-Roman findfont" is data for defining a font style of the characters to be input and "10 scalefont" is a data for defining a size of characters to be input. "setfont" is a data for indicating that the font style and size of characters to be input is set. "50 2000 moveto" is data for identifying the printing position on the paper for the characters to be input. "(We are brothers.)" is input character data and the data of "show" indicates that dot data of the character data is processed in RAM 4. "showpage" is a print execution command. In PS mode, when the above-described printing information is sent to the printer, "We are brothers." is printed on a printing paper.

In PS mode, when character data is input, data of a font style, size, position of characters and so on are always input with the character data. It is a feature that the above-described printing information satisfies a format X which is peculiar to PS mode. Therefore, if printing information which does not satisfy the peculiar format X of PS mode, for example, the above-described HP mode is sent to a printer of PS mode, a format error occurs and printing is not carried out.

A receiving buffer 11 and a simulation print flag 10 are provided in RAM 4. The receiving buffer 11 temporarily stores printing information received by the laser printer and the simulation print flag 10 stores a flag indicating whether data processing of the printing information is carried out in a simulation mode or not. When the printing information is processed in a simulation mode, the simulation print flag 10 is set to F=1 and when the printing information is not processed in a simulation mode, the simulation print flag 10 is reset to F=0.

Figure 2A:
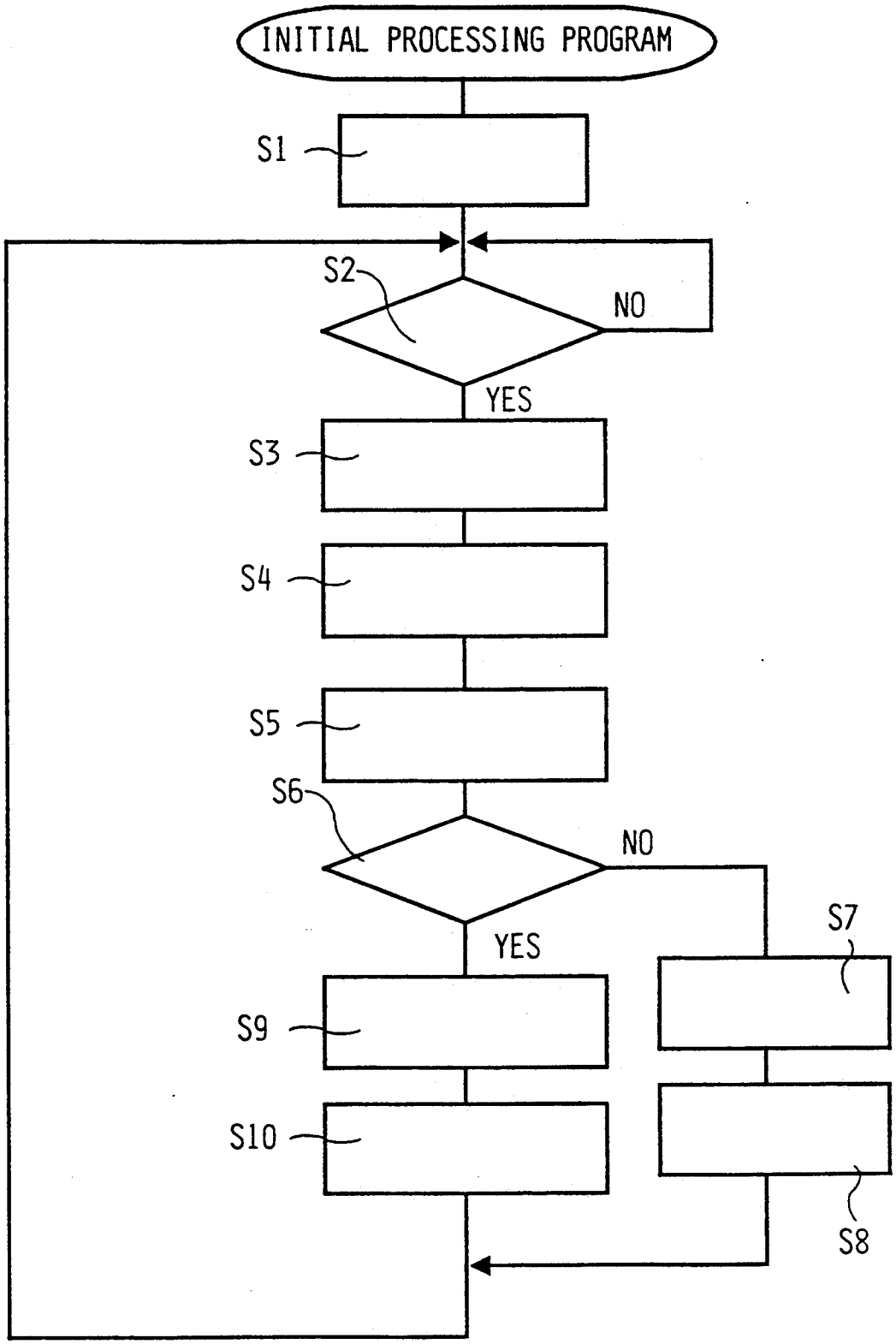
FIG. 2A is a flowchart of the initial processing program of a first embodiment.

The laser printer engine 7 is controlled when the control device 1 carries out data processing for printing the information input from the host computer 5. A main control program and an initial processing program shown in FIGS. 2A and 2B are stored in ROM 3 of the control device 1.

In response to the initial processing program, the operation of simulation printing is carried out by CPU 2 of the control device 1 in a simulating operation mode P which is a simulation mode of PS mode without actual printing according to the printing information stored in the receiving buffer 11 of RAM 4.

It is judged whether the input printing information satisfies the format of PS mode or not by the simulation printing operation in the simulating operation mode P. According to the resulting determination, it is judged whether the printing information is to be printed in HP mode having control code or in PS mode without control code. Afterwards, the printing operation is carried out in the determined operation mode which is compati7 ble with the printing information.

In the simulating operation mode P, which is a simulation mode of PS mode, printing data of the printing information is not sent to the laser printer engine 7. However, other than that, the data processing that is carried out is the same as that when the printing operation of PS mode is performed.

An operation mode determining processing by the initial processing program is explained by referring to FIGS. 2A and 2B.

When the power supply of the laser printer is turned on, the initial processing program is automatically initi7 ated by CPU 2. An initializing processing is first executed to initialize the laser printer at step S1 during which a self test is performed and the RAM 4 is initialized. Next, a judgement is made whether printing information has been input from the host computer 5 (S2). Then, if printing information H of HP mode has been input (S2:YES), the printing information H is stored temporarily in the receiving buffer 11 (S3).

The simulation print flag 10 is set to F=1 (S4). Then, printing operation, without any actual printing, is carried out in the simulating operation mode P, which is a simulation mode, of PS mode according to the printing information H stored in the receiving buffer 11 (S5). In the simulating operation mode P, which is a simulation mode of PS mode, the same data processing is performed as for that of PS mode, although printing data of the printing information is not sent to the laser printer engine 7. That is, the printing operation is not executed. The simulation printing is first carried out in an operation mode without control codes such as PS mode.

Next, it is determined whether the printing information H satisfied the above-mentioned format X which is peculiar to PS mode by during simulation printing operation (S6). That is, it is determined whether a format error has occurred or not. When the printing information H is the printing information of HP mode, it does not have a format which satisfies the format X of PS mode (S6:NO). Then, a format error is generated and the flag in the simulation print flag 10 is reset to F=0 (S7). The printing data H is then processed as printing information of HP mode which is the other operation mode. The printing information obtained by the data processing of HP mode is sent to the laser printer engine 7 and the printing operation is carried out in HP mode (S8).

On the other hand, in step S2, if the input printing information is printing information S of PS mode, the printing information S is stored temporarily in the receiving buffer 11 (S3) and the simulation print flag 10 is set to F=1. Then, a printing operation, without printing, is carried out in the simulating operation mode P which is a simulation mode of PS mode according to the printing information S stored in the receiving buffer 11 (S5).

It is determined whether the printing information S has a format that satisfies the format X which is peculiar to PS mode by executing the simulation printing operation (S6). Since the printing information S is that of PS mode, it has the format X of PS mode (S6:YES) and processing proceeds to S9. The simulation print flag 10 is reset to F=0 at S9. Then, the printing information S is processed as printing information of PS mode and the resulting printing data is sent to the laser printer engine 7 where a printing operation is carried out in PS mode (S10).

As explained above, it is determined whether the printing information has a format which satisfies the format X of PS mode by the simulation printing operation in the operation mode P, that is, it is determined whether the operation mode in which the printing information is to be printed is an operation mode having a control code or not. Therefore, it is possible to distinguish an operation mode without a control code from an operation mode having a control code thereby improving the ability to determine an operation mode.

In the first embodiment, the laser printer carries only one kind of operation mode without control code, that is PS mode. Therefore, if a simulation printing operation is carried out once and it is judged whether the printing information has a format that satisfies the format X of PS mode or not, it can be judged whether the operation mode in which the printing information is to be printed is an operation mode having a control code or not.

A second embodiment is described below. In this embodiment, a plurality of operation modes without control codes are stored in a laser printer. For those parts that are the same as those of the first embodiment, the same reference numbers are used and the explanation thereof is omitted.

For an example of the second embodiment, two operation modes without control codes, such as PS mode (Post Script mode) and PW mode, and one operation mode having a control code of ESC sequence code such as HP mode (Hewlett Packard mode) are stored in ROM 3.

Next, an operation mode determining processing performed by the initial processing program is explained with reference to FIGS. 3A and 3B.

Since the operations carried out in steps S1 to S5 are the same as those of the first embodiment, a detailed explanation thereof is omitted here. At step S2, if printing information H of HP mode is input from the host computer 5 and after a printing operation without any actual printing is carried out in the simulating operation mode P, which is a simulation mode for PS mode, according to the printing information H of HP mode (S5), it is determined whether the printing information H satisfied the format X which is peculiar to PS mode during the simulation printing operation (S6). That is, it is determined whether a format error has occurred.

When the printing information H is the printing information of HP mode, it does not have a format which satisfies the format X of PS mode (S6:NO). A format error is generated and a printing operation without any actual printing is carried out in the simulating operation mode W, which is a simulation mode of PW mode, according to the printing information H stored in the receiving buffer 11 (S11). Thus, the simulation printing is carried out first in one of the operation modes without control codes, such as PS mode or PW mode.

Then, in this example, it is determined whether the printing information H satisfies a format Y, which is peculiar to PW mode, during the simulation printing operation (S12). That is, it is determined whether a format error has occurred. When the printing information H is the printing information of HP mode, it does not have a format which satisfies the format Y of PW mode (S12:NO).

Next, a format error is generated and the simulation print flag 10 is reset to F=0 (S13). The printing data H is then processed as printing information of HP mode which is the other operation mode. The printing data obtained by the data processing of HP mode is sent to the laser printer engine 7 and the printing operation is carried out in HP mode (S14).

On the other hand, at step S2, if printing information S of PS mode is input from the host computer 5, the printing information S has a format which satisfies the format X of PS mode (S6:YES). The simulation print flag 10 is reset to F=0 at S9. Then, the printing information S is processed as printing information of PS mode. The resulting printing data is sent to the laser printer engine 7 where a printing operation is carried out in PS mode (S10).

Further, in step S2, if printing information W of PW mode is input from the host computer 5, the printing information W does not have a format which satisfies the format X of PS mode (S6:NO). A format error is generated and a printing operation without any actual printing is carried out in the simulating operation mode W, which is a simulation mode of PW mode, according to the printing information W stored in the receiving buffer 11 (S11).

Then, it is determined whether the printing information H satisfied a format Y which is peculiar to PW mode during the simulation printing operation (S12). That is, it is determined whether a format error has occurred. Since the printing information W is the printing information of PW mode, it has a format which satisfies the format W of PW mode (S12:YES) and the simulation print flag 10 is reset to F=0 (S15). Then, the printing information W is processed as printing information of PW mode. The resulting printing data is sent to the laser printer engine 7 where a printing operation is carried out in PW mode (S16).

If a printer carries a plurality of operation modes without control codes, simulation printing is carried out first in the one of the operation modes without control codes which has a top priority. Then, it is determined that the operation mode is not to be used, simulation printing is carried out next in another one of the operation modes without control codes which has a second priority. That is, simulation printing is carried out according to priority of each operation mode until a match is made. This priority is determined by, for example, a use frequency of the operation modes carried in the type of printer.

In the example of the second embodiment, since PS mode has a top priority and PW mode has a secondary priority, simulation printing is carried out first in PS mode.

If the printing apparatus has N (any number) different operation modes without control code, a simulation printing operation may be carried out at most N times. That is, it is judged whether the printing information has a format that satisfies the peculiar format of one of the operation modes without a control code if a determination is made at most N times testing against each operation mode without a control code in sequence. Then, it can be judged whether an operation mode in which the printing information is to be printed is an operation mode having a control code or not.

Figure 3A:
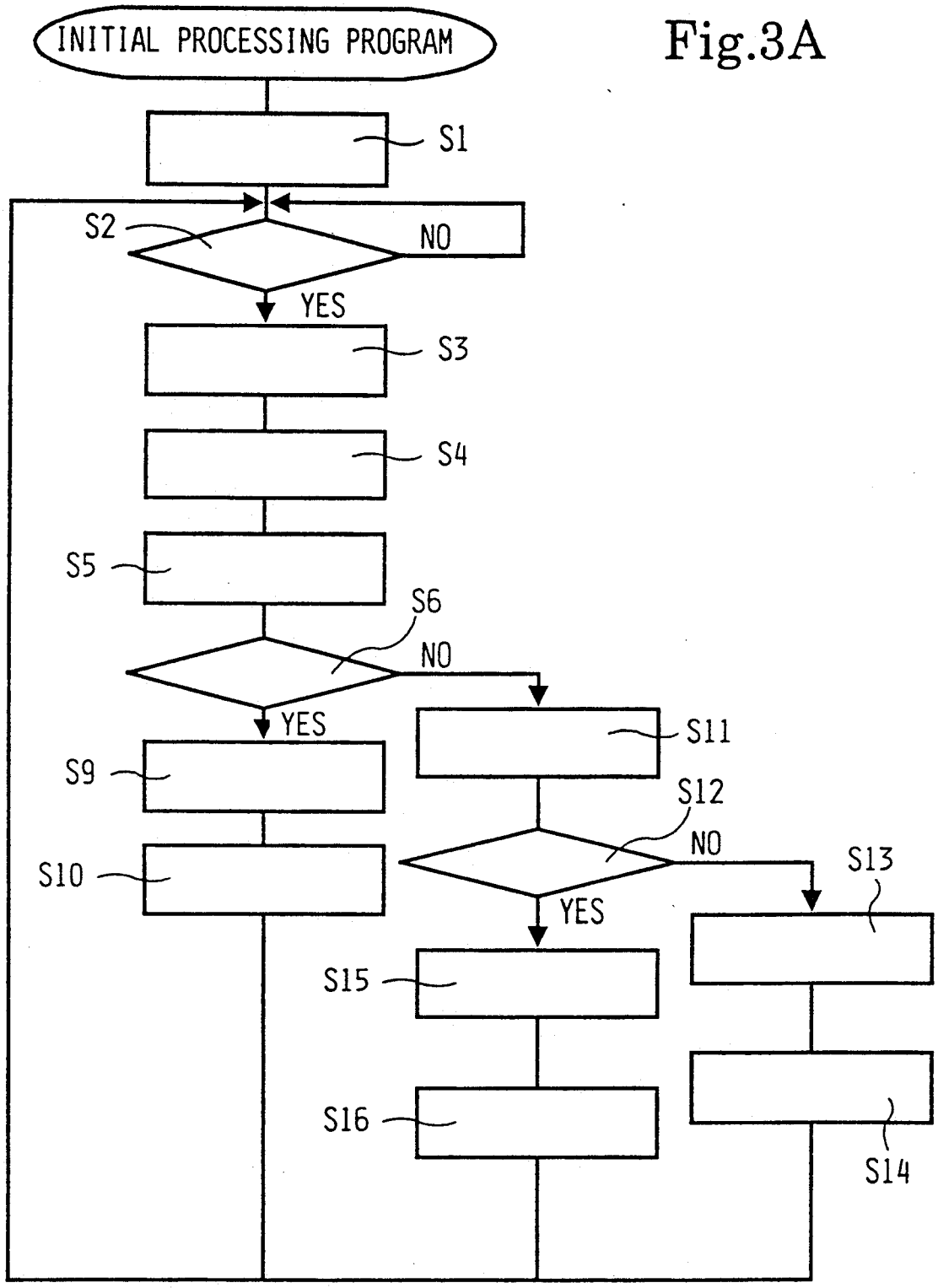
FIG. 3A is a flowchart of the initial processing program of a second embodiment.

After the operation of step S7 (FIGS. 2A and 2B) or step S13 (FIGS. 3A and 3B), if a printing apparatus has a plurality of operation modes having control codes, the determining processing to determine from among the plurality of operation modes which operation mode is to be used, to print the information input from the host computer, is carried out in place of step S8 (FIGS. 2A and 2B) or step S13 (FIGS. 3A and 3B). This determining processing is disclosed in U.S. Pat. No. 4,968,159 and owned by the assignee of this application. The disclosure of U.S. Pat. No. 4,968,159 is incorporated by reference. Therefore, it does not matter how many operation modes having a control code are carried in a printer.

It is to be understood that the invention is not restricted to the particular forms shown in the foregoing embodiments. Various modifications and alternations can be made thereto without departing from the scope of the inventions encompassed by the appended claims.

For example, the control device of the invention can be used for other type of printing apparatuses, such as ink jet printers or dot matrix printers.

What is claimed is:

1. A control device for a printing apparatus comprising:
   - printing data storing means for storing printing data;
   - printing means for printing images of the printing data on a printing medium;
   - driving means for driving the printing means;
   - operation mode storing means for storing at least one operation mode having a control code and at least one operation mode without a control code in one of which printing is carried out according to the printing data;
   - simulation printing means for simulating printing the printing data in a simulating operation mode corresponding to an operation mode stored in the operation mode storing means without executing the driving means;
   - error judging means for determining if an error has occurred when the simulating operation mode is executed by the simulation printing means; and
   - printing control means for controlling the driving means to drive the printing means to carry out printing according to the printing data in an operation mode corresponding to the simulating operation mode when the judging means determines an error has not occurred.

2. A control device according to claim 1, wherein the operation mode without control code has a peculiar format, and the error judging means determines an error has occurred when the printing data simulated to print by the simulation printing means does not satisfy the peculiar format and the error judging means determines an error has not occurred when the printing data simulated to print satisfies the peculiar format.

3. A control device according to claim 2, wherein the simulation printing means first simulates printing the printing data in a simulating operation mode corresponding to the operation mode without control code.

4. A control device according to claim 3, wherein when the error judging means determines an error has occurred, the printing data is simulated to print in a simulating operation mode corresponding to another operation mode without a control code stored in the operation mode storing means by the simulating printing means when a plurality of operation modes without control codes are stored therein.

5. A control device according to claim. 4, wherein the control code is ESC sequence code.

6. A control device according to claim 4, wherein the operation mode having its peculiar format is Post Script Mode.

7. A control device according to claim 3, wherein when the error judging means determines an error has not occurred, the printing data is printed by executing the driving means in the operation mode corresponding to the simulating operation mode in which an error has not occurred.

8. A control device according to claim 1, further comprising simulation printing setting means for setting a simulating operation mode corresponding to one of a plurality of operation modes when the simulation printing means is executed.

9. A control device according to claim 8, wherein the simulation printing setting means first sets a simulation operation mode corresponding to an operation mode without the control code.

10. A control device according to claim 9, wherein the control code is an ESC sequence code.

11. A control device according to claim 9, wherein the operation mode having the peculiar format is Post Script Mode.

12. A control device of a printing apparatus comprising:

printing data storing means for storing printing data;

printing means for printing images of the printing data;

driving means for driving the printing means;

operation mode storing means for storing at least one operation mode having control code and at least one operation mode without control code having a peculiar format in one of which printing is carried out by executing the driving means according to the printing data;

simulation printing means for simulating printing of the printing data in a simulating operation mode corresponding to an operation mode stored in the operation mode storing means without executing the driving means;

error judging means for determining whether the printing data which is simulated printed by the simulation printing means satisfies the peculiar format; and printing control means for controlling the driving means to drive the printing means to carry out printing according to the printing data in an operation mode corresponding to the simulating operation mode in which the error judging means determines the printing data simulated to print by the simulation printing means satisfies the peculiar format.

13. A control device according to claim 12, wherein the simulation printing means first simulates printing of the printing data in a simulating operation mode corresponding to a first of the at least one operation mode without control code.

14. A control device according to claim 13, wherein when the error judging means determines the printing data does not satisfy the peculiar format, the printing data is simulated to print in a simulating operation mode corresponding to another one of the operation modes without control code stored in the operation mode storing means if a plurality of operation modes without control code are stored therein.

15. A control device according to claim 14, wherein the control code is ESC sequence code.

16. A control device according to claim 14, wherein a one of the at least one operation mode having its peculiar format is Post Script Mode.

* * * * *